United States Patent [19]

Diamond

[11] 4,148,168

[45] Apr. 10, 1979

[54] JIG ASSEMBLY AND METHOD FOR THE MANUFACTURE OF PREFABRICATED ROOFING PANELS

[76] Inventor: John N. Diamond, P.O. Box 93, Malvern, Pa. 19355

[21] Appl. No.: 865,437

[22] Filed: Dec. 29, 1977

Related U.S. Application Data

[63] Continuation-in-part of Ser. No. 858,836, Dec. 8, 1977, abandoned.

[51] Int. Cl.[2] ..... E04G 21/00

[52] U.S. Cl. ..... 52/748; 52/749; 269/307

[58] Field of Search ..... 52/748, 551, 552, 749, 52/127, 656, 540; 33/188, 187; 269/307, 321 F

[56] References Cited

U.S. PATENT DOCUMENTS

| | | | |
|---|---|---|---|
| 2,887,781 | 5/1959 | Mills | 33/188 |
| 3,196,581 | 7/1965 | Castelli | 52/127 X |
| 3,866,644 | 2/1975 | Stubbs | 269/321 F X |
| 4,010,592 | 3/1977 | Nixon | 52/748 |

*Primary Examiner*—Ernest R. Purser
*Assistant Examiner*—Carl D. Friedman
*Attorney, Agent, or Firm*—Birch, Stewart, Kolasch & Birch

[57] ABSTRACT

A jig assembly and method for the manufacture of prefabricated roofing panels having a plurality of overlapped shingle courses. The jig comprises a planar frame with a central opening and various guide bars and indexing means. The method involves placing the shingle courses on a substrate. The jig is used to locate the shingle courses in proper alignment with each other and the substrate.

3 Claims, 12 Drawing Figures

JIG ASSEMBLY AND METHOD FOR THE MANUFACTURE OF PREFABRICATED ROOFING PANELS

BACKGROUND OF THE INVENTION

This application is a continuation-in-part of application Ser. No. 858,836 filed Dec. 8, 1977 by John N. Diamond, now abandoned.

FIELD OF THE INVENTION

The present invention relates to a method and jig for assembling a prefabricated roofing panel unit made from plywood, waterproof sheet material, such as asphalt-saturated felt and composition shingle strips all purchased directly from the mill, lumber yard or manufacturer.

DESCRIPTION OF THE PRIOR ART

The prior art conventional slanted or pitched-roof construction is implemented for example, by separately securing panels of half-inch thick plywood, sheets of asphalt-saturated felt and strip shingles to the roof. These are separately purchased usually from three separate sources of supply and transferred from each supply source to the job site. After delivery to the job site the panels of plywood are sawed into sections for proper size and affixed to the roof rafters. Then the felt sheets are cut to size and secured to the plywood and finally the strip shingles are suitably applied to the felt covered plywood as the final step to form a weatherproof layer.

Obviously this conventional roofing system requires several experts in the roofing trade to perform a completed installation.

Many attempts have been made in the prior art to prefabricate roofing panels to eliminate the need for the conventional form of assembly described hereinbefore. However, each of these prior art attempts has suffered from certain disadvantages and fallen far short of results achieved by the prefabricated panels of the present invention. For example, one such prefabricated roofing panel is described in U.S. Pat. No. 1,776,949 to Lumbard. The Lumbard panel is similar in appearance at first blush to the panel of the present invention but illustrates a waste of sheathing, namely, each shingle has its own sheathing rather than a plurality of shingles being affixed to a single sheathing panel. In addition, Lumbard's panel became outdated with the introduction of self-sealing shingles, since Lumbard's major purpose in affixing shingles to the sheathing was to prevent the shingles from blowing off the roof.

In the same vein the appearance of the panels of U.S. Pat. Nos. 3,505,770 to Bennett and 3,807,113 to Turner is that of a random abuttment arrangement of shingles whereas the panel of the present invention is layed out in a straight-line course.

The panel of U.S. Pat. No. 3,546,843 to Luebs has a somewhat similar appearance to that of the present invention, but like Lumbard, Luebs employs the overlapping of sheathing so that the roof is in effect single-shingled and double-sheathed.

The most significant definciency of all of the above prior art references of record is that the panel construction therein does not allow for the panel to be secured to the roof rafters throughout any part of its surface area. These panels allow for only the peripheral fastening around the edges of the panels to the roof rafters or along one definite line of fastening usually at a midlongitudinal point of the panel. In contradistinction, as will become more fully apparent hereinafter the panel of the present invention allows for fastening at any point simply by lifting any single tab on its surface area. The plurality of tabs are not sealed one to the other until the panels have been installed and exposed to the sun. Even then, there is the flexibility of separating and resealing the tab at any time thereafter.

Also, none of the existing prior art allows for reroofing without the dismantling of worn out panels and replacement of the same while the panels of the present invention are designed primarily for new construction, directly on the roof rafters, or for older homes where the existing roof and sheathing both need replacing. Otherwise, once the panels of the present invention have run their service lifetime of fifteen to twenty years, the panels can still be reroofed by applying individual strip shingles directly over the panels without replacing the sheathing. This gives a standard lifetime to the panels of the present invention of from forty-five to sixty years.

SUMMARY OF THE INVENTION

Accordingly, it is an object of the present invention to prefabricate a complete roof panel as a unit, so it may be purchased as a composite unit from one source of supply and then transferred to a jobsite and be lifted and applied by a carpenter to the roof rafters of a house structure.

Another object is to so shape and so form the prefabricated units that the underlay of plywood and felt sheathing of the panel is offset at selected edges with respect to the shingles and arranged in abutting relation to the frame structure of the house and with respect to each other on the roofing rafters.

Another object is to provide a novel system in a prefabricated panel of applying thereto the top weatherproof shingle strips, whereby the underlay felt covered plywood panels are easily fastened to the roof rafters at any point in situ simply and quickly by lifting any single tab of a shingle strip to expose the surface area of the rafter secured underlay for the driving therethrough of a suitable fastener, such as a staple or nail.

Yet another object and feature of the present invention is the formation of an interlocking and/or interweaving of the side edges of the respective shingle strips applied in lapping courses to the underlay panels secured in abutting relation with respect to each other and each respective roof rafter, to thereby present a coupled wetherproof interfit of the shingle side edges for each contiguous adjacent shingle strips of each unit.

Still another object of the present invention is to provide a jig assembly which facilitates dimensional uniformity in the manufacturing of the panels of the present invention and more specifically, dimensional uniformity in the amount of overlap of respective courses of shingles of the panels and the amount of overhang of the first course of shingles over the bottom edge of the plywood substrate.

A still further object of the present invention is to provide a jig assembly which enables one to apply shingles to the plywood substrate in a fast and efficient manner in uniformly straight courses.

BRIEF DESCRIPTION OF THE DRAWINGS

The foregoing and other advantages and objects of this invention will become more clearly understood by reference to the drawings wherein.

DETAILED DESCRIPTION OF DRAWINGS

Figure 1:
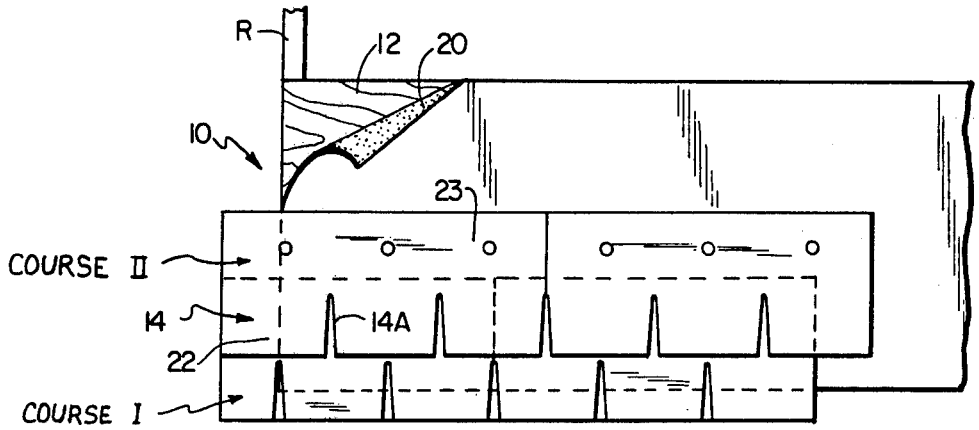
FIG. 1 is a partial top plan view of a roofing panel according to the present invention with some of the respective shingle strips applied.
Figure 2:
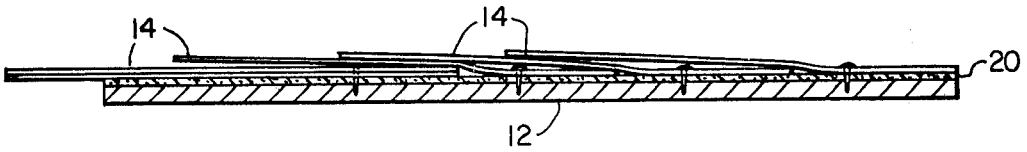
FIG. 2 is a side view in section of a roofing panel according to the present invention.

Referring to the drawings, first with reference to FIGS. 1 and 2, there is shown a preferred embodiment of my invention. This embodiment consists of a prefabricated structure 10 comprising an underlay panel, such as a plywood 12 coated with asphalt saturated felt 20 and a plurality of shingle strips 14 incised as at 14A to form tabs 22. These shingle strips 14 when systematically arranged and secured to the underlay panel give the appearance of a roof construction with a plurality of separate shingles of the size of tabs 22 defined by the spacing of incisions 14A.

The prefabricated roofing panels 10 of the present invention are made in advance away from the site of any building structures to be covered with a roof. For example, the panels may be made in a factory from a standard size of plywood to provide any suitable or desired size, such as from a 4'×8' sheet of ½" plywood cut into two 2'×8' pieces. The felt saturated asphalt sheets 20 and the shingles strips 10 are then secured to these panels to form a complete prefabricated roofing panel in the factory. These completed pre-fab panels 10 may then be transported to the jobsite and applied and secured to the roof rafters R of a building, see FIG. 3.

Each of the plywood pieces 12 are fabricated by laying the same lengthwise and then suitably applying a plurality of courses of the relatively smaller strips of shingles 14 in terraced or shingle lapped formation to the relatively larger exposed surface of the respective plywood pieces 12 by nailing or stapling the unincised upper elongated straight edges 23 of the shingles thereto. Each shingle sheet or strip 14 is secured along the upper longitudinal edge 23 only, so that the incised lower shingle tab portions 22 of each shingle sheet are not secured to the plywood base piece 12. Thus, each tab shingle section laps freely over its lower contiguous section of a shingle strip 14.

As illustrated in FIG. 1, the shingle strips of each respective course are offset to obtain the overall appearance of a conventional roof with individual shingles. For example, the lower "course I" of shingles, as viewed in FIG. 1, begins at the lower left-hand portion of the drawing (the edge of the roof) with a shingle strip 14 consisting of approximately two and one-half individual shingle tabs 22. The next adjacent shingle strip in "course I" is a full shingle strip including three tabs 22. In the next "course II" the first shingle strip on the left side edge of the roof is also a full shingle strip, as well as the adjacent shingle strip in "course II". Thus, it can be seen that the incisions 14A and the edges of the tabs 22 are staggered between adjacent courses to develop the appearance of a conventional roof with individual shingles. "Course III" of the panel (not shown) would be identical to "course I" and thus staggered or offset with respect to "course II" and so forth with the remaining courses.

To achieve flexibility in the construction of any given roof of any given dimensions it is contemplated to manufacture the roofing panels 10 in different dimensions with some differences in characteristics. For example, a full panel can be chosen or selected to be two feet by eight feet while a half panel of two feet by four feet can also be provided.

This cuts down on material waste in the following manner. Suppose a roof is 26' wide making a course across the roof twenty-six feet. To cover this course on would use three eight foot panels and one four foot panel with two feet of waste in the four foot panel. If only eight foot panels were available, there would be six feet of waste.

Figure 3:
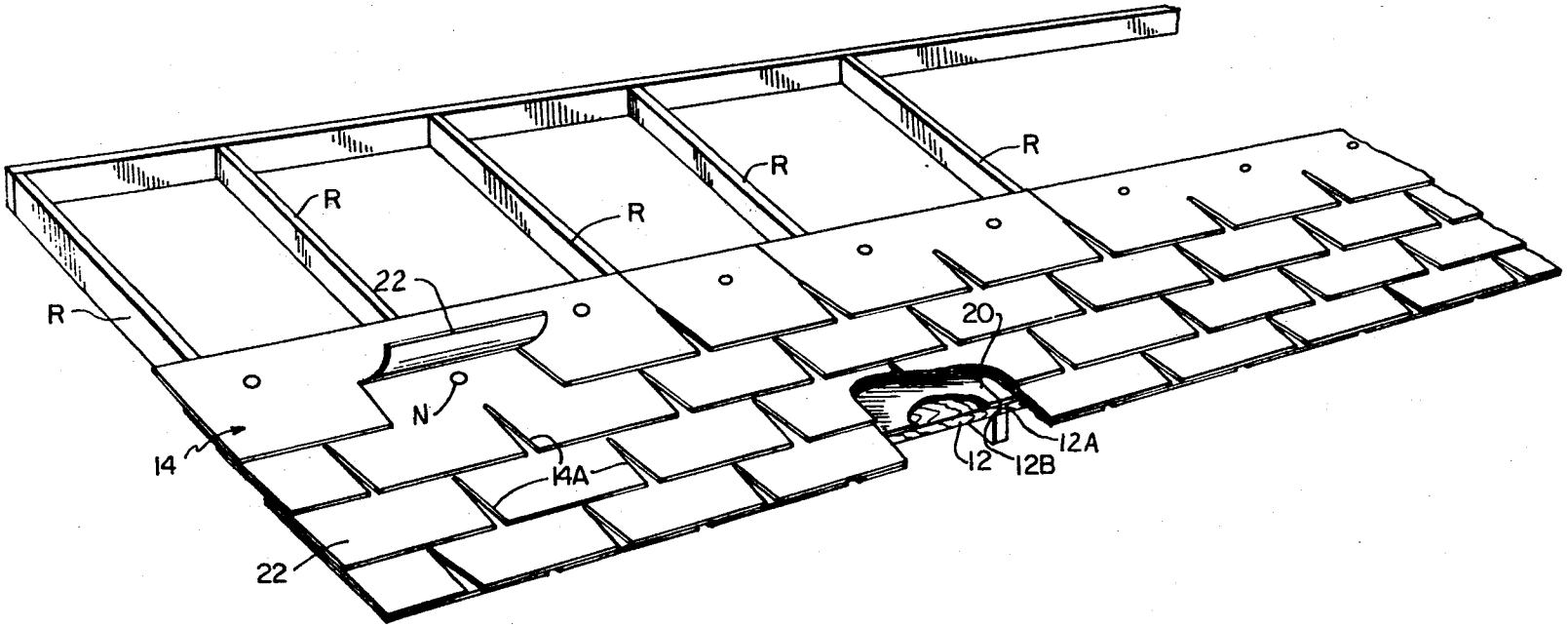
FIG. 3 is a perspective view of a portion of the rafters of a building roof to illustrate the abutting relationship of side panel edges of contiguously adjacent panels and showing a shingle tab raised to illustrate how a portion of the underpanel may be exposed for fastening to the roof rafters.

It is also preferred in practicing the present invention to have the shingles overlap all edges of the roof (the sides and bottom). This is illustrated in FIGS. 1 and 3 viewed together. As illustrated therein the shingles hang over the facia strip or bottom of the roof by approximately 1½ inches and over the side edge of the roof by approximately 5 inches. However, it is important to note that only the shingles hang over the roof edges. The plywood sheets 12 are installed flush with the edges of the roof. This makes it easier to trim the portions hanging over the roof edges since one must only trim the shingles per se and not the plywood.

Referring in detail to FIG. 3 there is illustrated other significant features of the present invention. As shown therein one shingle tab 22 is raised to illustrate how a roofing panel 10 may be nailed or stapled at positions N other than the peripheral edges to the roof rafters R. This is made possible by the use of self sealing shingles and by the construction of the present invention, whereby only the top portions 23 of each of the shingle strips 30 are secured to plywood panels 12. A selected shingle tab 22, as illustrated in FIG. 3 may be raised, a nail or staple driven through panel 10 at that point, and the shingle tab 22 may be placed back down flush with the roof surface. Due to the self sealing nature of shingles 14 when exposed to the heat of the sun, the shingles will form a liquid tight seal over the areas where the nails or staples are applied.

FIG. 3 also illustrates in the region where the shingles are cut away how the respective edges of the underlying plywood sheets at 12A, 12B abutt, while the shingles thereon overlap and interweave over the abutted edges.

Figure 4A:
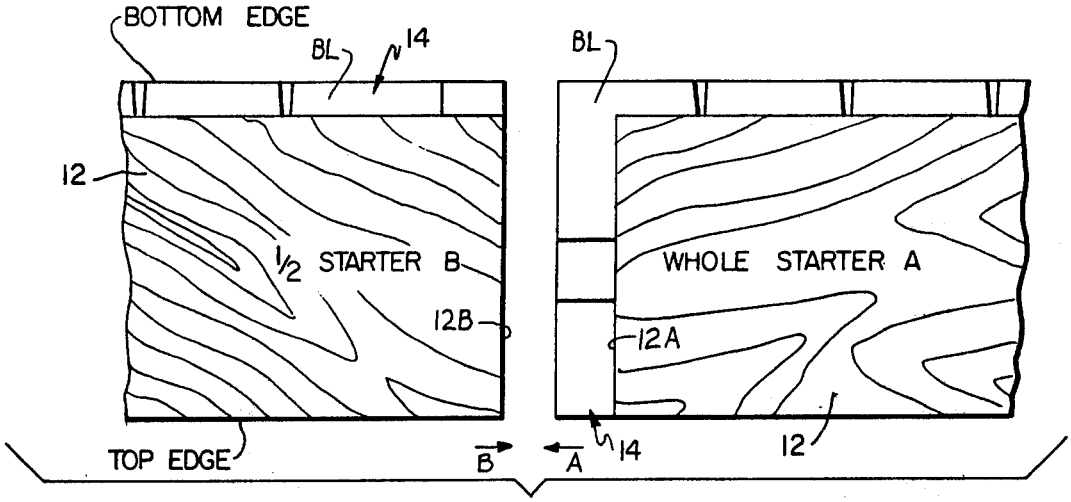
FIG. 4A is a bottom exploded view of a pair of interlocking and interwoven starter roofing panels according to the present invention.

This can be better illustrated in FIG. 4A which is an exploded view from the underside of two roof panels which are to be pushed together into interlocking, interwoven relationship along edges 12A, 12B, The two panels in FIG. 4A may be referred to as starter panels, "starter B" and "starter A" which comprise the first course of panels on the roof of FIG. 3. In FIG. 4 they are flipped over an inverted with respect to FIG. 3. Therefore, FIG. 4A illustrates the underside of the panels of FIG. 3 with the top and bottom edges inverted as indicated.

It should be understood that the panels of the present invention are to be secured to the rafters R of FIG. 3 in courses, not to be confused with the courses of shingles on each panel. For example, one course of starter panels is illustrated in FIG. 3 and successive filler courses will be provided above the course indicated. The panels of these successive courses will have shingles on the bottom plywood edges thereof which hang over said edges in lapping relationship with the singles on the top of the panels below.

In order to achieve the necessary interlocking, interwoven relationship of the shingles across the abutted ends of the respective panels, a preferred embodiment of the present invention provides a kit of at least four types of panels. This kit includes starter panels, type A and B, and filler panels, types A and B.

Figure 4B:
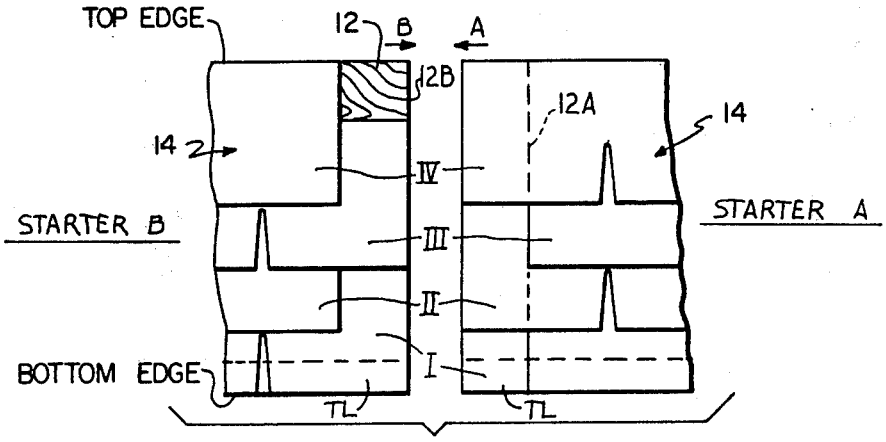
FIG. 4B is a top exploded view of the starter roofing panels of FIG. 4A.

The starter panels, "starter A" and "starter B" are illustrated in FIGS. 4A and 4B from the underside and topside, respectively. It should also be noted, as stated hereinbefore, that the top and bottom edges of these panels are inverted in the two figures to facilitate a better understanding of the details of the construction thereof. The top and bottom edges are appropriately labeled in each Figure.

The starter panels comprise the first course of panels in a roof such as illustrated in FIG. 3. Referring in more detail to FIGS. 4A and 4B the respective panels "starter A" and "starter B" have very specific abutting end configurations which enable the abutting ends 12A, 12B of the panels to interlock and interweave. As illustrated in FIG. 4A from the underside "starter A", shingles 14 of some of the respective courses overlap the end 12A of the panel. On the other hand none of the shingles 14 overlap the end 12B of "starter B". It should be noted that the starter panels A and B both have a double first course of shingles at the bottom edge of the panels which overlap said bottom edge. The bottom layers of this first course of shingles are indicated as BL in FIG. 4A.

Referring to FIG. 4B the top view of "starter A" and "starter B" illustrate that each panel has four courses of shingles 14 labeled I, II, III, and IV. The first course I, as stated hereinafter has two layers of shingles, the top layer being labeled TL in FIG. 4B.

The end shingles of the respective courses of the "starter A" panel have the following positional relationship to the end 12A thereof:

Course "I" - The end shingle top layer TL is flush with end 12A while the bottom layer BL overlaps end 12A and extends toward 12B.

Course "II" - The end shingle of this course overlaps edge 12A and extends toward edge 12B.

Course "III" - The end shingle of this course is flush with edge 12A.

Course "IV" - The end shingle of this course overlaps edge 12A and extends toward edge 12B.

The end shingles of the respective courses of "starter B" panel have the following relationship to the end 12B thereof:

Course "I" The end shingle bottom layer BL is indented from the edge 12B while the top layer TL is flush with edge 12B.

Course "II" The end shingle of this course is indented with respect to edge 12B.

Course "III" The end shingle of this course is flush with the end 12B.

Course "IV" The end shingle of this course is indented with respect to edge 12B.

Figure 5A:
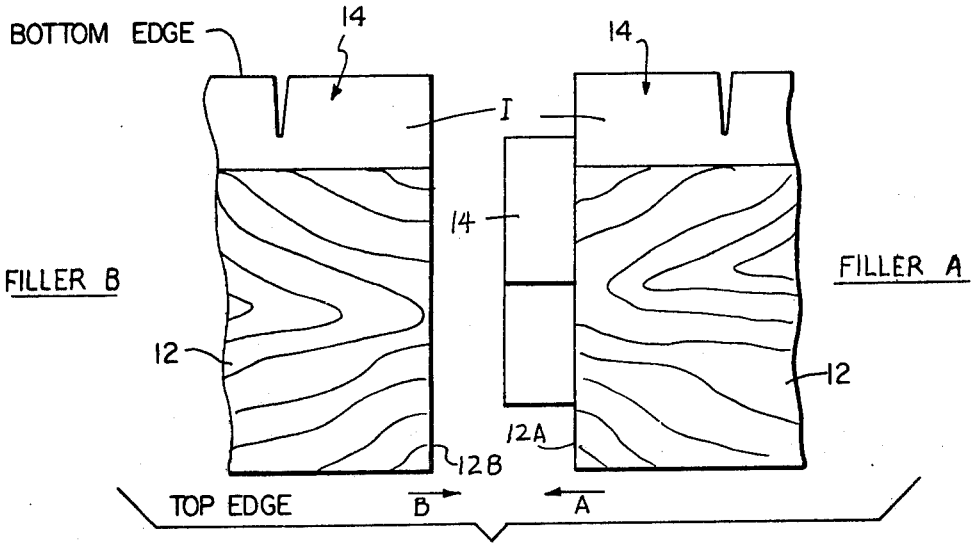
FIG. 5A is a bottom exploded view of a pair of interlocking and interwoven filler roofing panels according to the present invention.
Figure 5B:
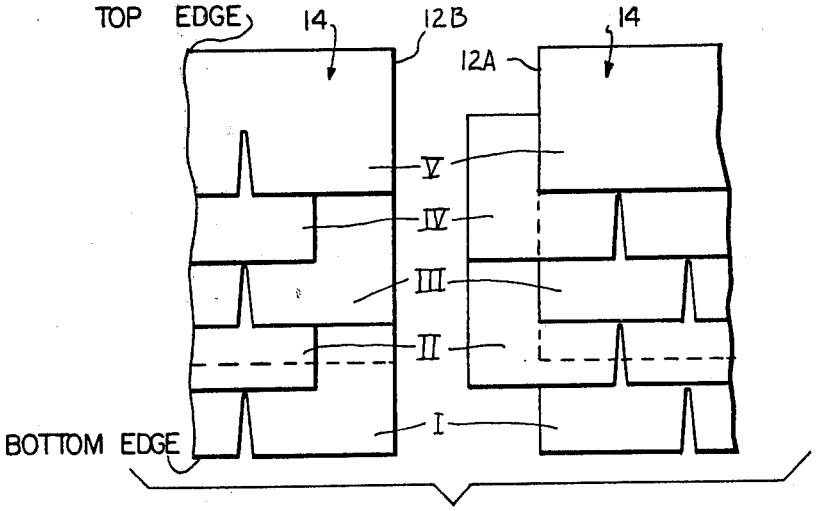
FIG. 5B is a top exploded view of the filler roofing panels of FIG. 5A.

The filler panels types A and B will be referred to hereinafter as "Filler A" and "Filler B", respectively, and are illustrated in FIGS. 5A and 5B. FIG. 5A shows the underside of the panels while FIG. 5B shows the topside of the panels. FIGS. 5A and 5B have the top and bottom edges of the respective panels inverted with respect to each other in a similar manner to FIGS. 4A and 4B.

As stated hereinbefore the "Filler A" and "Filler B" panels comprise the successive courses of panels on the roof of FIG. 3 above the starter panels.

Referring in detail to FIG. 5A, as seen from the underside, "Filler A" panel has some shingles 14 which overlap edge 12A and a first course I which overlaps the bottom edge. On the other hand "Filler B" has no overlapping shingles with respect to edge 12B and a course I which overlaps the bottom edge. It should be noted that the first course I of the filler panels has only a single layer of shingles and has five courses as viewed from the topside.

Referring in detail to FIG. 5B the end shingles of the respective courses of "Filler A" panel have the following positional relationship with respect to the end 12A:

Course "I" The end shingle is flush with end 12A.

Course "II" The end shingle overlaps end 12A and extends toward end 12B.

Course "III" The end shingle is flush with end 12A.

Course "IV" The end shingle overlaps end 12A and extends toward end 12B.

Course "V" The end shingle is flush with end 12A.

Referring in further detail to FIG. 5B the end shingles of the respective courses of "Filler B" panel have the following positional relationship with respect to end 12B:

Course "I" The end shingle is flush with end 12B.

Course "II" The end shingle is indented with respect to end 12B.

Course "III" The end shingle is flush with respect to end 12B.

Course "IV" The end shingle is indented with respect to end 12B

Course "V" The end shingle is flush with end 12B.

It should be understood that FIGS. 4A, 4B, 5A, 5B refer only to the abutting end configurations of the respective panels of the kit whereby plywood ends 12A, 12B are butted together and the respective shingles of panels A and B interlock and interweave. Panels of type A and type B are always butted together A to B or B to A laterally of the roof in each respective course of panels as indicated by the directional arrows in FIGS. 4A, 4B, 5A and 5B.

The lower course I of shingles of the filler panels overlap the upper course IV of the starter panels when placed on a roof. The next successive course of filler panels would have its lower course of shingles in overlapping relation with the upper course of shingles of the filler panel course therebelow and so forth.

Since the end configurations of the panels of the present invention are designed to interlock and interweave, it is very important that the courses of shingles on each respective panel be applied in uniform straight-line courses. In order to facilitate this, the present invention provides the jig assembly of FIG. 6.

Figure 6:
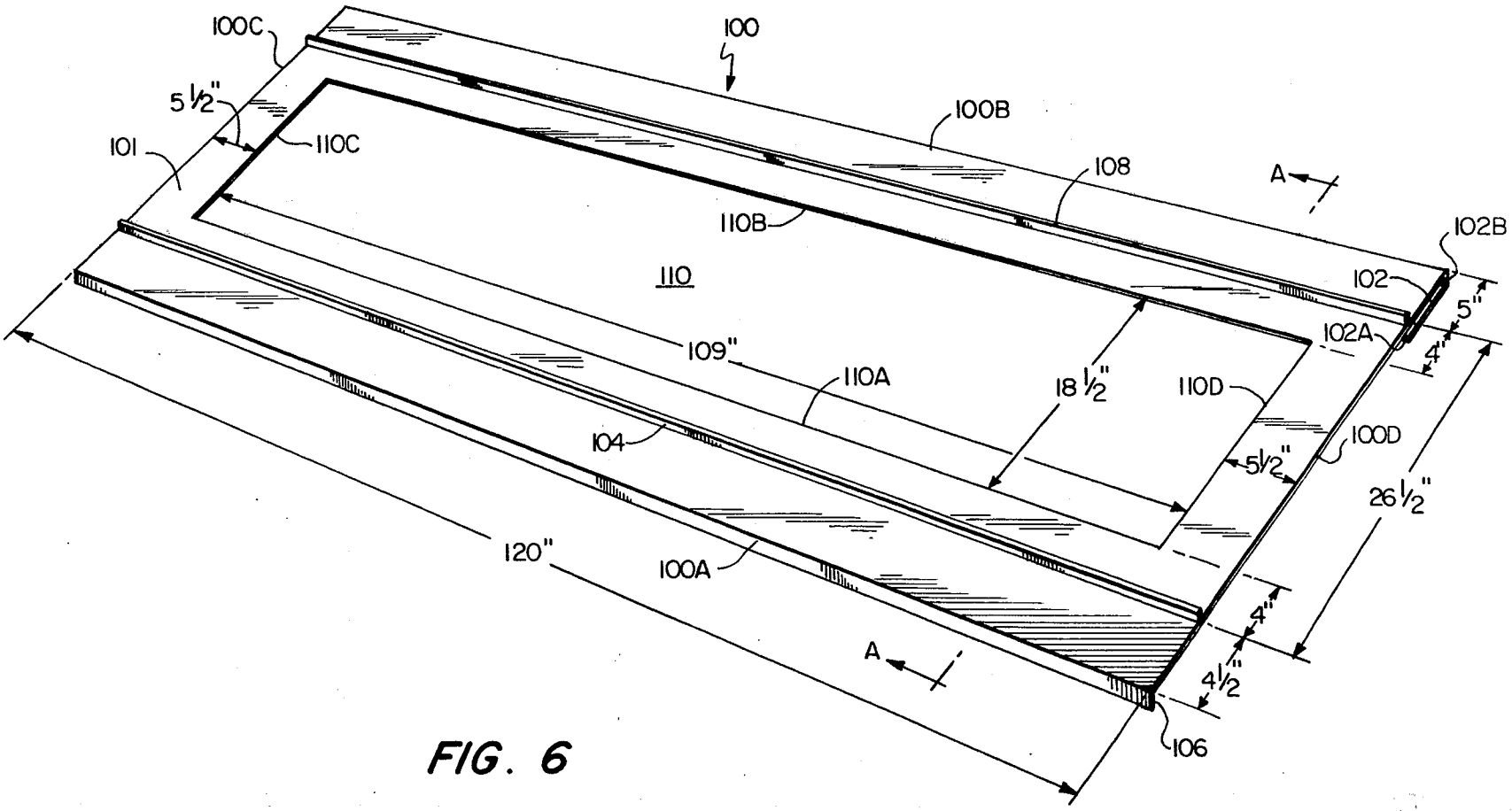
FIG. 6 is a perspective view of a jig assembly utilized for making the prefabricated panels of the present invention.

Referring in detail to FIG. 6 there is illustrated a jig assembly 100 having a general rectangular configuration formed from a piece of sheet material 101. Sheet material 101 is bent over at the bottom edge to form a downwardly depending flange or lip 106 and is bent over at the top edge to form a U-shaped channel 102 on the underside of the jig. A rectangular opening 110 is provided centrally of the jig 100 to provide access to materials disposed below the jig as will be discussed more fully hereinafter. A pair of guide bars 104, 108 are provided on the top side of jig assembly 100 and are spaced equidistantly from the longitudinal edges of opening 110 and parallel to said edges and to each other.

The relative dimensions of all of the components of the jig assembly of FIG. 6 are carefully chosen in accordance with the desired dimensional characteristics of the panels of the present invention.

For example, a typical roofing panel of the present invention would have a 2'×8' plywood substrate with 1'×3' shingle strips disposed thereon. For starter panels it is desired that the first course of shingle strips overlap the bottom edge of the plywood substrate by 2½" while for filler panels a 7" overlap is desired. It is also desired to secure each of the shingle strips to the plywood substrate by nails or staples at a distance of 5⅝" from the bottom of the shingle strip.

In order to achieve the above dimensions on the panels of the present invention the jig assembly of FIG. 6 has the following dimensions:

(1) The top surface of rectangular sheet 101 is ten feet long by three feet wide;
(2) Rectangular opening 110 is 109" long×18½" wide;
(3) U-shaped channel 102 is 5" wide from edge 102A to the inside back wall 102B and is ¼" deep;
(4) The inside edge of guide bar 108 is parallel to and spaced 4" from edge 110B of opening 110 and 5" from jig edge 100B;
(5) The inside edge of guide bar 104 is parallel to and spaced 4– from edge 110A and 4½" from jig edge 100A;
(6) The space between edges 100C–110C and 110D–100D is 5½ inches; and
(7) The flange 106 extends approximately ¼" down from the underside of the jig.

It should be understood that these dimensions can be varied or modified for different required dimensions of the roofing panels and that the above dimensions represent only a preferred embodiment of the present invention.

Figure 7A:
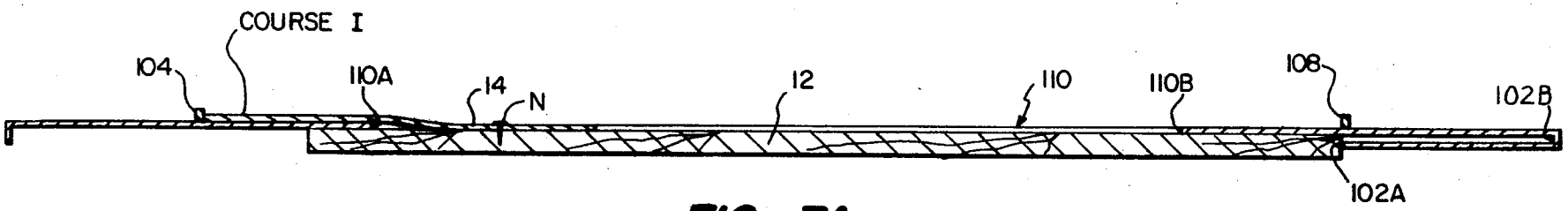
FIG. 7A is a sectional view of the jig assembly of FIG. 6 taken along line A-A illustrating how the first course of shingles is applied to a starter panel of the present invention.
Figure 7B:
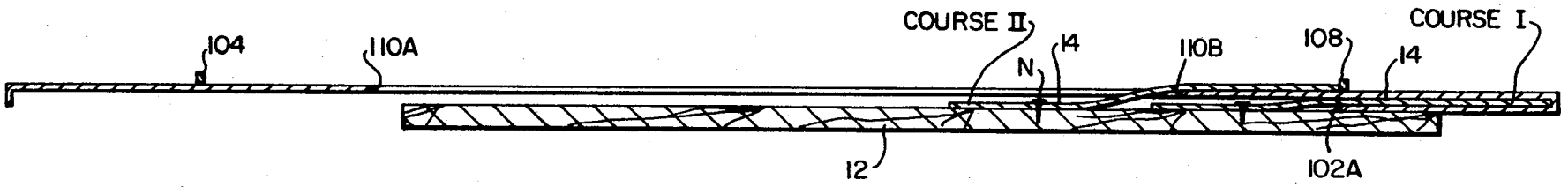
FIG. 7B is a similar view to FIG. 7A illustrating how a second course of shingles is applied to a starter panel of the present invention by use of the jig assembly of FIG. 6.
Figure 8A:
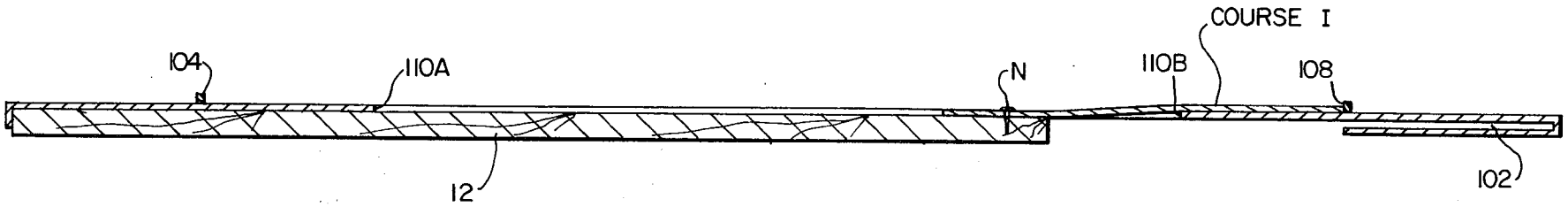
FIG. 8A is a similar view to FIG. 7A illustrating how the first course of shingles is applied to a filler panel of the present invention by use of the jig assembly of FIG. 6.
Figure 8B:
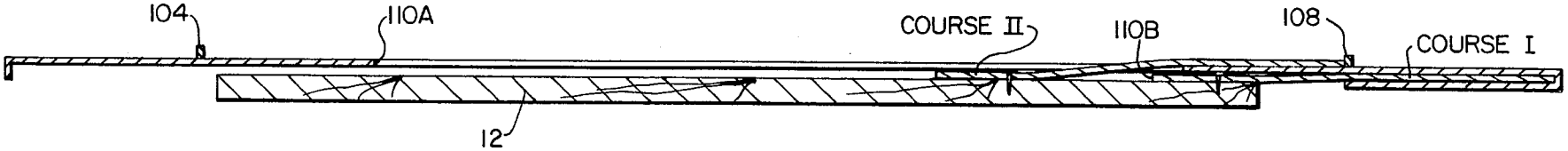
FIG. 8B is a similar view to FIG. 8A illustrating how a second course of shingles is applied to a filler panel of the present invention by use of the jig assembly of FIG. 6.

The operation of the jig assembly of FIG. 6 can be best understood by reference to FIGS. 7A, 7B, 8A, and 8B. FIGS. 7A, 7B illustrate the assembly steps for the respective courses of shingles for starter panels of the present invention. FIGS. 8A, 8B illustrate the assembly steps of the respective courses of shingles of filler panels of the present invention.

Referring in detail to FIG. 7A a plywood substrate 12 2' wide×8'long is placed under jig 100 with its top longitudinal edge indexed on edge 102A of flange 102. In this position the opposite longitudinal edge of substrate 12 is spaced 2½" from the inside edge of guide bar 104. A first course of shingle strips 14 is then applied to substrate 12 by indexing the bottom edges of shingle strips 14 on guide bar 104. This provides a 2½" overhang at the bottom edge of plywood substrate 12 which is desirable for a starter strip. Only one layer of the first course of shingles is illustrated in FIG. 7A for the sake of simplicity. However, it should be understood that in a preferred embodiment the first course of shingles on a starter panel of the present invention has two layers of shingle strips. The shingle strips are secured to substrate 12 by nails or fasteners N through opening 110 at approximately 5⅝" from the bottoms of the shingle strips. The panels are then removed from jig 100 in preparation for the application of the next course of shingle strips in the manner illustrated in FIG. 7B.

Referring in detail to FIG. 7B the substrate 12 including the first course of shingles is turned around so that the bottom edge of the first course of shingles is inserted in U-shaped channel 102 all the way to the end wall 102B thereof. A second course of shingle strips "Course II" is then indexed on guide bar 108 as shown in FIG. 7B. These shingles are secured to substrate 12 by nails N through opening 110. To apply the third course of shingles the bottom edge of "Course II" of shingles is inserted into channel 102 all the way to the end wall 102B and secured in a like manner by nails through opening 110. The fourth course of shingles for the starter panel is secured in a similar manner by placing the bottom edges of the third course in channel 102 against wall 102B and nailing them to the panel through opening 110. A completed starter panel is then removed from the jig assembly. This starter panel has straight-line courses of shingles uniformly overlapped by 7" and with a 2½" overlap at the bottom edge of substrate 12.

Referring in detail to FIGS. 8A and 8B there is illustrated the assembly steps in jig 100 for filler panels according to the present invention having a 7" overlap of the bottom edge of the substrate and 7" overlap between the five courses of shingles.

As illustrated in FIG. 8A the two by eight foot plywood substrate 12 is placed with its top longitudinal edge indexed on flange 106. This leaves a 7" space between the bottom edge of substrate 12 and the inside edge of guide bar 108. Thus, by indexing the bottom edges of the first course of shingles "Course I" on the inside edge of guide bar 108, the first course of shingles on the filler panels of the present invention has a uniform 7" overlap along the bottom edge of substrate 12.

The successive second through fifth courses of the filler panels of the present invention are applied to substrate 12 in the manner indicated in FIG. 88. As illustrated therein shingle "Course I" is inserted into channel 102 with the bottom edge thereof against end wall 102B. The bottom edges of the second course of shingles, "Course II" is then indexed on guide bar 108 and nailed to substrate 12 through opening 110. The bottom edges of the second course of shingles are then inserted into channel 102 against end wall 102B. The third course of shingles is then applied by indexing the bottoms of the shingles on guide bar 108 and securing the same by nails through opening 110. The bottom edges of the third course of shingles are then inserted into channel 102 against end wall 102 B and the fourth course of shingles is applied by indexing on guide bar 108 and securing to substrate 12 through opening 110. The bottom edges of the fourth course of shingles is then inserted into channel 102 against end wall 102B and the fifth course applied by indexing on guide bar 108 and securing to substrate 12 through opening 110.

Thus, a filler panel according to the present invention is formed having five courses of shingles with a 7" overlap between courses and a 7" overhang over the bottom edge of substrate 12.

It can be seen from the foregoing description of operation that the roofing panels of the present invention can be mass produced with uniformity by use of the jig assembly of the present invention.

It should be further understood that the panels of the present invention may be modified as would occur to one of ordinary skill in the art without departing from the spirit and scope of the present invention.

For example, the felt layer 20 may be eliminated if desired or in the alternative aluminum foil, insulating board, or foam panels may be used in its place.

What is claimed is:

1. A jig assembly for use in the manufacturing of prefabricated roofing panels having a plurality of straightline shingle courses secured to a substrate in overlapping relationship between adjacent courses and with a predetermined distance of overlap between the bottom edges of a first course of shingles and the bottom edge of said substrate comprising:

(a) rectangular frame means having first and second planar surfaces and a central rectangular portion removed therefrom in the provision of a central access opening through said frame means, said access opening having its longitudinal edges disposed parallel to the first and second longitudinal edges of said frame means;

(b) first guide bar means disposed parallel to a first longitudinal edge of said rectangular frame means between said first longitudinal edge and said access opening on a first planar surface of said frame, said first guide bar means projecting outwardly from said first planar surface in a direction perpendicular thereto;

(c) second guide bar means disposed on said first planar surface parallel to a second longitudinal edge of said rectangular frame means on the opposite side of said access opening from said first guide bar means, said second guide bar means projecting outwardly from said first planar surface in a direction perpendicular thereto;

(d) a first indexing projection on a second surface of said frame means opposite from said first surface, said first indexing projection being in registry with said first longitudinal edge of said frame means said first indexing projection projecting outwardly from said second surface in a direction perpendicular thereto;

(e) a second indexing projection on said second surface in registry with said second longitudinal edge, said second indexing projection projecting outwardly from said second surface in a direction perpendicular thereto; and (f) a third indexing projection affixed to said second indexing projection spaced inwardly of said frame means a predetermined distance from said second indexing projection and spaced from said second planar surface of said frame means by a predetermined distance.

2. A method of making a prefabricated roofing panel having a plurality of straight-line courses of shingles secured to a substrate in overlapping relationship between adjacent courses and with a predetermined distance of overlap between the bottom edges of a first course of shingles and the bottom edge of said substrate with a jig assembly including rectangular frame means having first and second planar surfaces and a central rectangular portion removed therefrom in the provision of a central access opening through said frame means, said access opening having its longitudinal edges disposed parallel to the first and second longitudinal edges of said frame means, first guide bar means disposed parallel to a first longitudinal edge of said rectangular frame means between said first longitudinal edge and said access opening on a first planar surface of said frame, second guide bar means disposed on said first planar surface parallel to a second longitudinal edge of said rectangular means on the opposite side of said access opening from said first guide bar means, a first indexing projection on a second surface of said frame means opposite from said first surface, said first indexing projection being in registry with said first longitudinal edge of said frame means, a second indexing projection on said second surface in registry with said second longitudinal edge, and a third indexing projection spaced inwardly of said frame means a predetermined distance from said second indexing projection and spaced from said second planar surface of said frame means by a predetermined distance comprising the steps of:

(a) placing a rectangular substrate against said second planar surface of said frame means with its top edge indexed on said third indexing projection and its bottom edge disposed inwardly of said first guide bar means by a distance equal to a desired distance of overhang of the bottom edges of a first course of shingles over the bottom edge of said substrate;

(b) placing a plurality of shingles on said first surface of said frame means with the top edges thereof contacting said substrate through said access opening and the bottom edges thereof indexed on said first guide bar means;

(c) securing said top edges of said first course of shingles to said substrate through said access opening;

(d) removing said substrate and said first course of shingles from said frame means;

(e) placing the bottom edges of said first course of shingles against said second indexing projection and said substrate against said second surface of said frame means; and (f) applying at least one more course of shingles to said substrate by indexing the bottom edges thereof on said second guide bar means and by securing the top edges thereof to said substrate through said access opening.

3. A method of making a prefabricated roofing panel having a plurality of straight-line courses of shingles secured to a substrate in overlapping relationship between adjacent courses and with a predetermined distance of overlap between the bottom edges of a first course of shingles and the bottom edge of said substrate with a jig assembly including rectangular frame means having first and second planar surfaces and a central rectangular portion removed therefrom in the provision of a central access opening through said frame means, said access opening having its longitudinal edges disposed parallel to the first and second longitudinal edges of said frame means, first guide bar means disposed parallel to a first longitudinal edge of said rectangular frame means between said first longitudinal edge and said access opening on a first planar surface of said frame, second guide bar means disposed on said first planar surface parallel to a second longitudinal edge of said rectangular frame means on opposite oppoite side of said access opening from said first guide bar means, a first indexing projection on a second surface of said frame means opposite from said first surface, said first indexing projection being in registry with said first longitudinal edge of said frame means, a second indexing projection on said second surface in registry with said second longitudinal edge, and a third indexing projection spaced inwardly of said frame means a predetermined distance from said second indexing projection and spaced from said second planar surface of said frame means by a predetermined distance comprising the steps of:

(a) placing a rectangular substrate against second planar surface of said frame means with its top edge indexed on said first indexing projection and its bottom edge disposed inwardly of said second guide bar means by a distance equal to a desired distance of overhang of the bottom edges of a first course of shingles over the bottom edge of said substrate;

(b) placing a plurality of shingles on said first surface of said frame means with the top edges thereof contacting said substrate through said access opening and the bottom edges thereof indexed on said second guide bar means;

(c) securing said top edges of said first course of shingles to said substrate through said access opening;

(d) removing said substrate and said first course of shingles from said frame means;

(e) placing the bottom edges of said first course of shingles against said second indexing projection and said substrate against said second surface of said frame means; and (f) applying at least one more course of shingles to said substrate by indexing the bottom edges thereof on said second guide bar means and by securing the top edges thereof to said substrate through said access opening.

* * * * *